US007279448B2

(12) United States Patent
Erhan et al.

(10) Patent No.: US 7,279,448 B2
(45) Date of Patent: Oct. 9, 2007

(54) POLY(HYDROXY THIOETHER) VEGETABLE OIL DERIVATIVES USEFUL AS LUBRICANT ADDITIVES

(75) Inventors: Sevim Z. Erhan, Peoria, IL (US); Atanu Adhvaryu, Peoria, IL (US); Brajendra K. Sharma, Peoria, IL (US)

(73) Assignees: The United States of America, as represented by the Secretary of Agriculture, Washington, DC (US); The PENN State Research Foundation, University Park, PA (US)

( * ) Notice: Subject to any disclaimer, the term of this patent is extended or adjusted under 35 U.S.C. 154(b) by 462 days.

(21) Appl. No.: 10/887,127

(22) Filed: Jul. 8, 2004

(65) Prior Publication Data

US 2006/0009365 A1 Jan. 12, 2006

(51) Int. Cl.
*C10M 135/24* (2006.01)
*C07C 67/00* (2006.01)

(52) U.S. Cl. ..... 508/491; 554/24; 554/102; 554/124; 554/149

(58) Field of Classification Search ..... 508/491; 554/102, 149
See application file for complete search history.

(56) References Cited

U.S. PATENT DOCUMENTS 3,986,966 A 10/1976 Wakim et al.
4,181,617 A 1/1980 Elrod et al.
4,380,499 A * 4/1983 Kammann et al. ..... 508/339
4,559,153 A 12/1985 Baldwin et al.
5,023,312 A 6/1991 Erickson et al.
5,282,989 A 2/1994 Erickson et al.
5,595,965 A * 1/1997 Wiggins ..... 508/491
5,703,022 A * 12/1997 Floyd ..... 508/345
6,534,454 B1 * 3/2003 Garmier et al. ..... 508/491
6,583,302 B1 * 6/2003 Erhan et al. ..... 554/213
6,620,772 B2 * 9/2003 Garmier ..... 508/491
6,624,124 B2 * 9/2003 Garmier ..... 508/491
2005/0197390 A1 9/2005 Byers et al.
2005/0197391 A1 9/2005 Refvik et al.
2006/0036110 A1 2/2006 Brown et al.
2006/0111520 A1 5/2006 Byers et al.

OTHER PUBLICATIONS

Princen, L. H., et al., "Development of New Crops for Industrial Raw Material", JAOCS, vol. 61, No. 2, Feb. 1984, pp. 281-289.
Kammann, Jr., Karl P., et al., "Sulfurized Vegetable Oil Products as Lubricant Additives", JAOCS, vol. 62, No. 5, May 1985, pp. 917-923.
Miwa, Thomas et al., "Sulfurized Jojoba Oil as Extreme-Pressure Lubricant", Proc.I Second Int. Conf. on Jojoba and Its Uses, Ensenada, Baja California, Norte, Mexico, 1976, pp. 253-264.
Molenda, Jaroslaw, et al., "Unsaturated Oxygen Compounds as Antiwear Additives for Lubricants" Tribologia, pp. 323, 324, 330 (1999).

* cited by examiner

*Primary Examiner*—Ellen M. McAvoy
(74) *Attorney, Agent, or Firm*—John D. Fado; Randall E. Deck; Lesley Shaw

(57) ABSTRACT

A novel class of chemically-modified vegetable oils is prepared by reacting epoxidized triglyceride oils with thiols. The resultant poly(hydroxy thioether) derivatives have utility as antiwear/antifriction additives for environmentally-friendly industrial oils and automotive applications.

19 Claims, 5 Drawing Sheets

POLY(HYDROXY THIOETHER) VEGETABLE OIL DERIVATIVES USEFUL AS LUBRICANT ADDITIVES

BACKGROUND OF THE INVENTION

1. Field of the Invention

This invention relates to sulfur-modified vegetable oils that have utility as antiwear/antifriction additives for lubricant base oils.

2. Description of the Prior Art

Antiwear/antifriction lubricants typically comprise a base oil that has been blended with any number of additives that enhance the ability of the base oil to withstand the mechanical stresses of interacting working surfaces under boundary lubrication conditions. Most of the lubricants and many of the additives currently in daily use originate from petroleum base stocks that are toxic to environment, making it increasingly difficult for safe and easy disposal. There has been an increasing demand for "green" lubricants [Rhee, I., *NLGI Spokesman*, 60 (5):28 (1996)] and lubricant additives in recent years due to concerns about loss of mineral oil-based lubricants to the environment and increasingly strict government regulations controlling their use.

Vegetable oils are readily biodegradable, safe to handle, environmentally friendly, non toxic fluids that are also readily renewable resources [Salunkhe, D. K. et al., World Oil Seed Chemistry, Technology and Utilization, Van Nostrand Reinhold, New York, (1992) pp. 1-8; Bockish, M. (ed.) Fats and Oils Handbook, AOCS Press, Champaign, (1998) 838]. The triacylglycerol structure of vegetable oil, which is also amphiphilic in character, give it an excellent potential as a candidate for use as a lubricant or functional fluid [Zaher, F. A. et al., Vegetable oils and lubricants, *Grasas Aceites* (Seville), 39:235-238 (1988); Willing, A., *Chemosphere*, 43:89-98 (2001)]. Triacylglycerol molecules orient themselves with the polar end at the solid surface making a close packed monomolecular [Brockway, L. O., *J. Colloid Sci*., 2:277-289 (1947)] or multimolecular layer [Fuks, G. I., Research in surface forces, A. B. V. Deryagin (ed.) Consultants Bureau, New York (1963) 29-88] resulting in a surface film on the material being lubricated. In addition, the vegetable oil structure provides sites for additional functionalization, offering opportunities for improving on the existing technical properties such as thermo-oxidative, low temperature stability and lubricity. These properties make them very attractive for industrial applications that have potential for environmental contact through accidental leakage, dripping, or generation of large quantities of after-use waste materials requiring costly disposal [Randles, S. J., et al., *J. Syn. Lubr*., 9:145-161 (1992); Dick, R. M., *Process*, 41:339-365 (1994)].

Limitations on the use of vegetable oil in its natural form as an industrial base fluid or as an additive relate to poor thermal/oxidation stability [Becker, R., et al., *Lubr. Sc*., 8:95-117 (1996); Adhvaryu, A., et al., *Thermochimica Acta*, 364 (1-2):87-97 (2000) and ref. within], poor low temperature behavior [Asadauskas, S., et al., *J. Am. Oil Chem. Soc*., 76: 313-316 (1999); Adhvaryu, A., et al., *Thermochimica Acta*, 395:191-200 (2003) and ref. within], and other tribochemical degrading processes [Brophy, J. E. et al., *Ann N.Y. Academy Sci*., 53:836-861 (1951); Miller, A. et al., *Lubr. Eng*., 13:553-556 (1957)] that occur under severe conditions of temperature, pressure, shear stress, metal surface and environment. To meet the increasing demands for stability during various tribochemical processes, the oil structure has to withstand extremes of temperature variations, shear degradation and maintain excellent boundary lubricating properties through strong physical and chemical adsorption with the metal. The film-forming properties of triacylglycerol molecules are believed to inhibit metal-to-metal contact and progression of pits and asperities on the metal surface. Strength of the protective fluid film and extent of adsorption on the metal surface dictate the efficiency of a lubricant's performance. It has also been observed that friction coefficient and wear rate are dependent on the adsorption energy of the lubricant [Kingsbury, E. P., *ASLE Trans*., 3:30-33 (1960)].

The antiwear properties of commercial additives are derived from a variety of elements capable of reacting with the metal surface and establish a stable protective film. Phosphorus, sulfur, nitrogen and zinc constitute the active element in most mineral oil based commercial antiwear additives. However, due to environmental and toxicological considerations, phosphorus may eventually be phased out from usage in the automotive industry because it has been implicated with catalyst deactivation fitted in catalytic converters [Wei, Dan-ping, *Lubr. Sci*., 7:365-377 (1995)].

Elrod et al. (U.S. Pat. No. 4,181,617) teach an aqueous drilling fluid lubricant consisting essentially of the reaction product of a fatty vegetable oil with 4,4'-thioldiphenol. Exemplary vegetable oils include castor oil, coconut oil, corn oil, palm oil and cottonseed oil.

Baldwin et al. (U.S. Pat. No. 4,559,153) discloses a metal working lubricant comprising a mineral or synthetic oil, and optionally a vegetable oil, and a sulfur-containing carboxylic acid such as n-dodecythioacetic acid and n-butylthioacetic acid. The sulfur-containing additives contemplated by Baldwin et al. are represented by the formula: R—S—R'$CO_2$H.

In an effort to find replacements for sulfurized sperm whale oil, early attempts to sulfurize vegetable oils have resulted in products that displayed a high level of intermolecular cross-linking, and were thus characterized by unacceptable viscosities. Miwa et al. (Proc. Second Int. Conf. on Jojoba and Its Uses, Ensenada, Baja Calif., Norte, Mexico, 1976, pp. 253-264) reports reacting jojoba oil with elemental sulfur. Products from unrefined jojoba oil thickened badly during gear lubricant tests. Similarly, Princen et al. [*J. Amer. Oil Chemists Soc*., 61:281-89, (1984)] found that sulfurization of the unaltered meadowfoam oil triglyceride oil yielded a factice that was unacceptable as a lubricant additive. Various attempts by Princen et al. to sulfurized wax esters of meadowfoam oil yielded products that had good lubrication properties, but were characterized by one or more deficiencies, such as having a tendency to corrode copper, excessive foaming, unacceptable thermal stability and thicken during gear box tests. Also, Kammann et al. [*J. Amer. Oil Chemists Soc*., 62:917-23 (1985)] found that sulfurized vegetable triglyceride oils resulted in rubbery products, in some cases even at a 12% sulfur content. Likewise, Wakim (U.S. Pat. No. 3,986,966) teaches that sulfurization of triglycerides yield resinous products mostly insoluble in base oils, and require the addition of nonwax fatty acid methyl esters to improve their solubility.

Erickson et al. (U.S. Pat. Nos. 4,925,581, 4,970,010, 5,023,312, and 5,282,989) are drawn to a lubricating composition consisting essentially of a lubricant base and a lubricant additive. The lubricant additive comprises a mixture of at least two components selected from three classes: the first class of ingredients comprises a triglyceride vegetable oil, a wax ester of the vegetable oil, and a combination thereof; the second class of ingredients comprises: a sulfurized vegetable oil wax ester; a sulfurized triglyceride vegetable oil within the range of from about 25% to about 75% vegetable oil, and from about 25% to about 75% of a wax ester, and a combination thereof; and the third class comprises a phosphite adduct of triglyceride vegetable oil, a phosphite adduct of the vegetable oil wax ester, and a combination thereof. The native vegetable oils contemplated for use by Erikson comprise fatty acids having from about 16 to about 26 carbon atoms and at least one double bond, preferably meadowfoam oil, rapeseed oil or crambe oil.

SUMMARY OF THE INVENTION

By virtue of this invention, we now provide a novel class of chemically-modified vegetable oils prepared by reacting epoxidized triglyceride oils with thiols. The resultant poly (hydroxy thioether) derivatives have utility as antiwear/antifriction additives for industrial oils and automotive applications.

In accordance with this discovery, it is an object of this invention to provide novel vegetable oil derivatives.

It is also an object of the invention to provide environmentally-friendly vegetable oil-based industrial fluids having acceptable antiwear/antifriction performance properties.

Another object of the invention is to introduce a new use for vegetable oils and to expand the market for an agricultural commodity.

A further object of the invention is to produce industrial fluids that reduce the demand on petroleum resources and that are biodegradable.

It is another object of the invention to provide a synthetic route for converting epoxidized sites of unsaturation in triglyceride fatty esters to thioether functionality.

Other objects and advantages of this invention will become readily apparent from the ensuing description.

DETAILED DESCRIPTION

Figure 1:
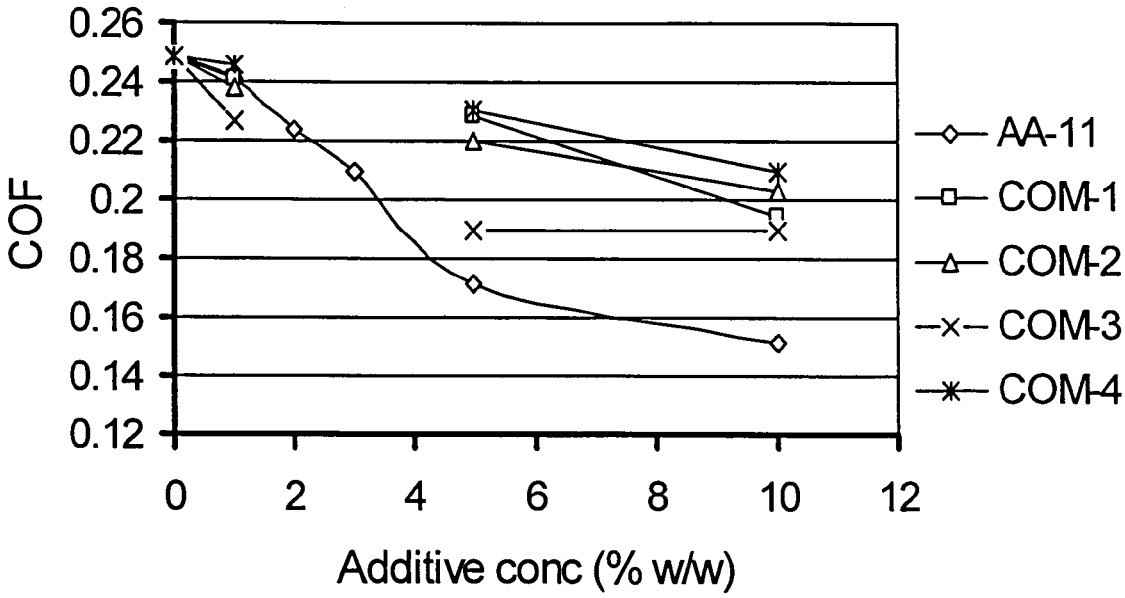
FIG. 1 is a line graph showing COF as a function of additive concentration (in % w/w) for the 1-butane thioether of epoxidized soybean oil (AA-11) of the invention as compared to four commercial antifriction/antiwear additives using a ball-on-disk test geometry (5 rpm, 181.44 Kg for 15 minutes at room temperature).

The vegetable oil-based lubricants of the invention are derived from triglycerides composed of fatty acid ester groups that collectively comprise at least one site of unsaturation. However, it would be appreciated by the person in the art that the more sites of unsaturation, the higher attainable level of antifriction/antiwear functionality. The oils principally contemplated herein include what are normally referred to as the triglyceride drying oils. The vegetable triglyceride drying oils include plant oils and plant source-like synthetic and semi-synthetic triglycerides that can be transformed into hard, resinous materials [see *Encyclopedia of Polymer Science and Technology*, H. F. Monk et al., eds., John Wiley & Sons, (1966), pp. 216-234]. The expression "drying oils" is generic to both true drying oils, which dry (harden) at normal atmospheric conditions, and semidrying oils, which must be baked at elevated temperatures in order to harden. Unless otherwise indicated, "drying oil" will be used herein in its broadest sense to refer to both types of drying oil. The unsaturated fatty acids (linoleic or linolenic) residues of a drying or semidrying oil comprise double bonds that are readily available for entering into an oxidative reaction, or other reactions involved in the drying process. These oils may also include oleic fatty acid residues. Common sources of drying oils include cotton seed oil, castor oil, canola oil, linseed oil, oiticica oil, safflower oil, soybean oil, sunflower oil, corn oil, and tung oil. Of these oils, soybean oil is most readily available in both its unmodified and epoxidized state, and is therefore the most preferred. The properties of the subject industrial lubricants can be tailored by blending together different drying oils, or by blending drying oils with non-drying oils. Non-drying oils substantially comprise saturated and/or monounsaturated fatty acid residues, such as those characteristic of palmitic, stearic and oleic acid. Exemplary nondrying oils include palm, peanut, olive, and grape oils.

Due to ready availability and low cost, the preferred vegetable use herein is soybean oil. The fatty acid constituents of soybean oil are mainly oleic (C18:1), linoleic (C18:2) and linolenic (C18:3) acids. Though the relative distribution of fatty acids is largely dependent on the seed type and its genetic makeup, soybean oil typically consists of $C_{16}$=4%, $C_{18}$=3%, $C_{18:1}$=22%, $C_{18:2}$=66% and $C_{18:3}$=5%. The generic chemical structure of vegetables oils for use in the invention is represented by Formula I, below:

Formula I

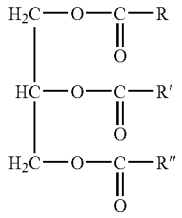

wherein R, R' and R" are independently selected from C7 to C21 aliphatic fatty acid residues, that may be completely saturated or have sites of unsaturation and/or hydroxylation, provided that R, R' and R" collectively have at least 2, and preferably at least 3 sites of unsaturation. In most of the common vegetable oils listed above, the triglyceride esters are composed of C18 fatty acids, and accordingly R, R' and R" are C17.

The drying oil is first either partially or completely epoxidized. The resultant oxirane rings are then available for cross-linking. Epoxidation may be carried out as described by Qureshi et al. [*Polymer Science and Technology*, Vol. 17, Plenum Press, p. 250] or by any other method as known in the art. It is desired that all, or substantially all (at least about 90%, and preferably at least about 95%), of the sites of unsaturation be epoxidized. The degree of epoxidation should be such that there are at least 2, and preferably at least 3 oxirane rings per triglyceride molecule. Typically, epoxidized soybean oil would have 3-7 oxirane rings per molecule, each characterized by the following chemical structure:

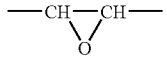

Formula II

Sulfur-containing reactants for use herein include hydrogen sulfide ($H_2S$), and any C1 to C22 thiol, including straight and branched chains, substituted or unsubstituted C4-C6 ring structures, including carbon rings and heterocyclic rings, wherein the chains or rings are either saturated or unsaturated. Substituents on the chains and rings may be independently selected from the group of halogen, nitro, amino, hydroxyl, ether, thioether and the like. These reactants are represented by the following generic structure:

Formula III wherein R''' is (1) hydrogen; (2) a C1 to C22 hydrocarbon, wherein said hydrocarbon is a straight or branched chain, substituted or unsubstituted, saturated or unsaturated; (3) a 4- to 6-member heterocyclic ring, wherein said ring is substituted or unsubstituted, saturated or unsaturated; or (4) a mixture thereof. In general, the larger the R''' group, the less viscous the resultant poly(hydroxy thioether) derivative.

The reaction of the epoxidized oil with the sulfur-containing reactant takes place in a single-step reaction in the presence of a suitable catalyst, such as perchloric acid. The presence of one or two epoxy groups per fatty acid chain renders the functionalized triglyceride oil highly susceptible to acid catalyzed ring opening in a suitable protic medium. Other catalysts could be used provided that they are capable of simultaneously opening the oxirane ring and promoting the addition of the thiol residue without hydrolyzing the ester group and thereby cleaving the fatty acid chains from the glycerol backbone. This reaction is preferably conducted at elevated temperatures, usually exceeding about 45° C.

The reaction, wherein the thiol is 1-butane thiol is exemplified as follows:

Reaction Scheme I

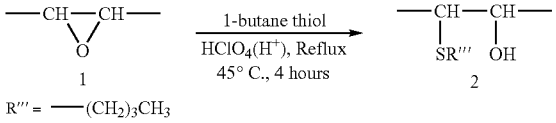

wherein 1 represents the oxirane ring in epoxidized vegetable oil and 2 represents the hydroxy thioether reaction product.

The resulting compounds are characterized by the following structural formula:

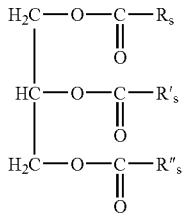

Formula IV wherein $R_s$, $R_s'$ and $R_s'$ are independently selected from C7 to C21 aliphatic chains comprising derivatized methylene groups characterized by the following structural formula:

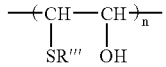

Formula V wherein R''' is (1) hydrogen; (2) a C1 to C22 hydrocarbon, wherein said hydrocarbon is a straight or branched chain, substituted or unsubstituted, saturated or unsaturated; (3) a 4- to 6-member heterocyclic ring, wherein said ring is substituted or unsubstituted, saturated or unsaturated; or (4) a mixture thereof. Of course it is understood that, depending on the particular thiol or mixture of thiols selected for the reaction, and also on the reaction conditions, some of the oxirane rings on the aliphatic chains may remain unreacted.

The poly(hydroxy thioethers) of this invention have superior properties which render them useful as additives to base stocks for biodegradable lubricant applications, such as crankcase oils, transmission fluids, two-cycle engine oils, marine engine oils, greases, hydraulic fluids, drilling fluids, metal cutting oils, and the like. By virtue of eliminating unsaturation in the starting triglyceride oil in favor of branching at the original sites of unsaturation, the thermal and oxidative stability of the molecule is significantly improved. Moreover, the viscosity of the branched derivative is substantially higher than that of the precursor oil due to hydrogen bonding between proximate —OH substituents, but is much lower than the viscosities of cross-linked sulfurized vegetable oils. It is believed that the low coefficient of friction characteristic of the poly(hydroxy thioethers) is due to both the excellent boundary lubrication properties of the vegetable oil structure, and also due to the ability of the sulfur atom to react with the steel surface to form a stable iron sulfide surface coating. It is well-established that polar functional groups (particularly —OH groups) in the triacylglycerol (triglyceride) molecule take part in physical and chemical interactions with metallic surfaces under high load and sliding contact [Beltzer et al., ASLE transactions, 30: 47-54 (1986); Molenda et al., *Triboligia*, 3: 323-330 (1999)], and that these interactions contribute to antiwear properties. The polar group serves as a point of attachment of the hydrocarbon to the metal, with the non-polar end forming a molecular layer separating the rubbing surfaces. Thus, the chemical modification of vegetable oil described herein both increases the number of polar groups (hydroxyls) in the molecule and provides available sulfur to the system for stable iron sulfide film formation on metal surfaces.

Base stocks useful in the lubricant formulations contemplated by the invention are typically high molecular weight hydrocarbons, and may be of mineral, vegetable, or synthetic origin, or mixtures thereof. Exemplary base oils are described in Erickson et al. (U.S. Pat. No. 5,023,312, incorporated herein by reference). Of course, the objectives of the invention to maximize the biodegradability of the lubricant system would be achieved with a vegetable oil base stock.

Though formulations of base stocks with the poly(hydroxy thioethers) of the invention meet or exceed many, if not all, specifications for lubricant end-use applications, it is contemplated that other additives may be used in conjunction with the poly(hydroxy thioethers) in order to enhance the properties of the base stock. Illustrative of these additives are detergents, antiwear agents, antioxidants, viscosity index adjusters, pour point depressants, corrosion protectors, friction coefficient modifiers, colorants and the like as well-known in the art.

The amount of poly(hydroxy thioether) additive formulated with a base oil will of course depend upon the end-use application of the formulation. For most of the end-uses indicated above, the concentration of additive will be in the range of about 1-12% (w/w), typically at least about 4% (w/w), and preferably in the range of about 5-8% (w/w).

The following examples are intended to further illustrate the invention, without any intent for the invention to be limited to the specific embodiments described therein.

EXAMPLE 1

Synthesis of Polyhydroxy Thio-Ether Derivative of Soybean Oil from Epoxidized Soybean Oil and 1-Butane Thiol.

Epoxidized soybean oil (ESBO) was obtained with a purity level of 98% from Elf Atochem (Philadelphia, Pa.), and was used without any further purification. Perchloric acid ($HClO_4$, 70%, ACS Reagent), methylene chloride, sodium bicarbonate, anhydrous magnesium sulfate from Fisher Scientific (Springfield, N.J.) and 1-butane thiol from Aldrich Chemicals (Milwaukee, Wis.) were used as obtained.

The reaction was carried out with a mixture of 25 gm ESBO and 10 ml 1-butane thiol dissolved in 400 ml methylene chloride, in a three-neck 1000 ml round bottom flask under dry nitrogen gas atmosphere (See Reaction Scheme I, supra). Perchloric acid (70 drops) was added drop-wise to the reaction mixture that was constantly agitated by a magnetic stirrer. Thereafter, heat was increased to the refluxing temperature of 45° C. and continued for 4 hours. After the reaction was complete, the mixture was cooled to room temperature and the organic phase was washed with 200 ml aqueous 5% sodium bicarbonate solution and deionized water (each 2 times) to remove any trace of acid catalyst remaining in the system. The organic phase was dried with anhydrous magnesium sulfate for 12 hours and later filtered. Solvent was removed under reduced pressure at 80° C., and the final product (AA-11) stored under dry vacuum overnight. The product obtained in 90-95% yield was characterized by a yellowish-brown color with a garlic-like odor. It was analyzed by $^1H$ and $^{13}C$ NMR at an observing frequency of 400 and 100 MHz respectively, by FTIR over a scanning range of 600-4000 $cm^{-1}$, and by the PDSC method using a DSC 2910 thermal analyzer from TA Instruments at a constant pressure of 1378.95 KPa (200 PSI) and 10° C./min heating rate.

In the ensuing discussion, compound 1 and product (derivative) 2 refer to Reaction Scheme I, supra. $^1H$ NMR studies on compound 1 indicate that the methine proton of —$CH_2$—CH—$CH_2$— backbone was observed at δ 5.1-5.3 ppm, methylene proton of —$CH_2$—CH—$CH_2$— backbone at δ 4.1-4.4 ppm, $CH_2$ proton adjacent to two epoxy group at δ 1.65 to 1.85 ppm, —CH— protons of the epoxy ring at δ 2.8-3.2 ppm, α-$CH_2$ to >C═O at δ 2.2-2.4 ppm, β-$CH_2$ to >C═O at δ 1.55-1.7 ppm, α-$CH_2$ to epoxy group at 1.7-1.9 ppm, β-$CH_2$ to epoxy group at δ 1.4-1.55 ppm, saturated methylene groups δ 1.1-1.4 ppm and terminal —$CH_3$ groups at δ 0.8-1.0 ppm region. Product 2 retains most of the characteristic peaks of compound 1 except those at δ 2.8-3.2 ppm and δ 1.4-1.55 ppm region, corresponding to Hs attached to epoxy groups and methylene groups adjacent to epoxy groups, respectively. Some additional peaks at δ 5.8-5.9 ppm corresponding to —OH and several broad overlapping peaks in the range δ 3.3-3.8 ppm from —CH (OH) were identified. The relative position of the hydroxyl peak (singlet, 5.8-5.9 ppm) varied from δ 4.8-6.0 ppm with respect to their abundance and position in the fatty acid chain of product 2. This, in addition to peaks at δ 2.45-2.55 ppm from —$CH_2$ adjacent to two carbons linked to thioether group and at δ 2.55-2.75 ppm from —CH—S—$CH_2$—, were also identified in derivative 2. Relative intensity and chemical shift of individual peaks from Hs at substituted carbon sites in derivative 2 varied slightly with the amount and position of epoxy rings in compound 1. The above spectral data suggests that controlled ring opening of compound 1 was followed by a simultaneous formation of hydroxyl group and a thioether chain at the epoxy carbon sites in product 2.

FTIR spectra of poly(hydroxy thioether) derivative 2 (AA-11) shows well resolved peaks at 722, 755, 1099, 1165, 1240, 1377, 1460, 1741, 2851, 2925 and 3431 $cm^{-1}$. The absorption due to the epoxy group (822 and 842 $cm^{-1}$) in compound 1 is not observed in derivative 2. This fact suggests that compound 1 undergoes complete or near complete ring opening under the reaction condition. The consequent generation of free —OH groups results in dimeric (3550-3400 $cm^{-1}$) and a smaller amount of polymeric (3400-3200 $cm^{-1}$) association through H-bonding. Hydrogen bonds result in broadening of the —OH absorption in the range (3550-3200 $cm^{-1}$), and these are readily broken on dilution. The presence of these intermolecular H-bond increases the viscosity of product 2.

The PDSC data presented in Table 1 verifies that removal of sites of unsaturation in SBO by converting them to epoxy groups (compound 1), followed by introducing branching at the epoxy carbons, significantly improves the thermal and oxidative stability of the oil.

EXAMPLES 2-5

Tribochemical Evaluation

Friction Measurement Using Ball-on-Disk Configuration.

The 1-butane thiol-ether soybean oil derivative prepared in Example 1, hereafter referred to as "AA-11" was evaluated using a ball-on-disk configuration on a Falex® friction and wear test apparatus (Model Multi-Specimen, Falex® Corporation, Sugar Grove, Ill.). The test zone was a shaft-supported ball moving on a stationary disk (point contact)

with a specified speed. The ball was held by the shaft of the upper specimen holder to make a point contact radius of 11.9 mm on the disk. The disk was attached on the bottom specimen holder and enclosed in a fluid tight cup. The resistance to the motion of the ball (i.e. friction force) was measured by a load cell connected to the stationary disk. The coefficient of friction (COF) is obtained by dividing the friction force by the normal force pressing the ball against the disk. The balls (52100 steel, 12.7 mm diameter, 64-66 Rc hardness and extreme polish) and disks (1018 steel, 25.4 mm outer diameter, 15-25 Rc hardness and 0.36-0.46 μm roughness) were both obtained from Falex® Corp. and were thoroughly degreased by sonication with fresh reagent grade methylene chloride and hexane (Aldrich Chemical Co., Milwaukee, Wis.) prior to each experiment.

Fifty ml of the test fluid was poured into the cup to totally immerse the ball and disk. The disk assembly was then raised and allowed to touch the ball attached to the shaft. The shaft holding the ball was then rotated to attain the set speed and immediately after that, the load was applied to reach the set value.

Antiwear Measurement Using Four-Ball Configuration.

This experiment was designed to study the anti-wear properties of additives under sliding contact by four-ball test geometry using a Falex® apparatus (Model Multi-Specimen, Falex® Corporation, Sugar Grove, Ill.). The test zone consisted of a top ball rotating in the cavity of three identical balls in contact and clamped in a cup below, containing the test fluid. The resistance to the motion of the ball was measured by a load cell connected to the stationary cup on the load platform, containing the 3 balls. Appropriate load is applied from below and the top ball was rotated at a set speed for a particular length of time. The balls (52100 steel, 12.7 mm diameter, 64-66 Rc hardness and extreme polish) were thoroughly cleaned with methylene chloride and hexane before each experiment.

Data Collection and Display

For both the ball-on-disk and the four ball configurations, the sample chamber was fitted with a thermocouple to record any change in temperature during the test period. The instrument was equipped with a PC and software that allowed for automatic acquisition and display of the following data at any selected rate: torque on the disk (friction force), vertical height change (wear), load, speed, chamber temperature (test oil), specimen temperature (stationary disk) etc. During a given experiment, the coefficient of friction was calculated by the instrument and displayed in real time.

Disk wear track width (WTW) and scar diameter on balls was measured using an optical microscope attached to a digitized moving platform. Five measurements were recorded at different positions of the wear track and the average value taken in each case. The disk WTW and scar-diameter are reported in millimeters.

EXAMPLE 2

First Ball-on-Disk, Coefficient of Friction Evaluation

Coefficient of friction properties of AA-11 in toluene solution compared with four commercial additive packages (multi-component additives) COM-1 through COM-4 were evaluated at two different concentrations. The duration of friction test was 15 min at a sliding speed of 6.22 mm/sec (5 rpm) and normal load of 181.44 Kg (400 lb) at room temperature. The temperature of specimen and test fluid was 25±2° C., which increased by 2-3° C. at the end of the 15 min test period. Friction and other data were recorded until the set time elapsed. A duplicate test was conducted with the same test fluid and new set of ball and disk. Data reported are average of the two tests with ±5% mean standard deviation.

FIG. 1 shows that COF sharply decreased with increasing additive concentration in base fluid (in this case toluene) and levels off at higher concentration. The rate of decrease in COF (as observed from the slope for different additive concentrations, 0-10 w/w %) at the given experimental conditions is largely influenced by additive structure and the ability of the additive to form a stable tribochemical film on the metal surface during the rubbing process. Additive AA-11 demonstrated significant lowering of COF with 5% w/w concentration in sharp contrast to the commercial additive packages. COM-1 through COM-4 show a steady state condition at a much higher friction coefficient value than AA-11. The excellent antiwear properties of AA-11 derive from its ester structure, due to its vegetable origin, and the ability of the molecule to release sulfur to coordinate with metal (iron) atoms during the tribochemical process.

EXAMPLE 3

Second Ball-on-Disk

Wear Track Width Evaluation (1% w/w)

Figure 2:
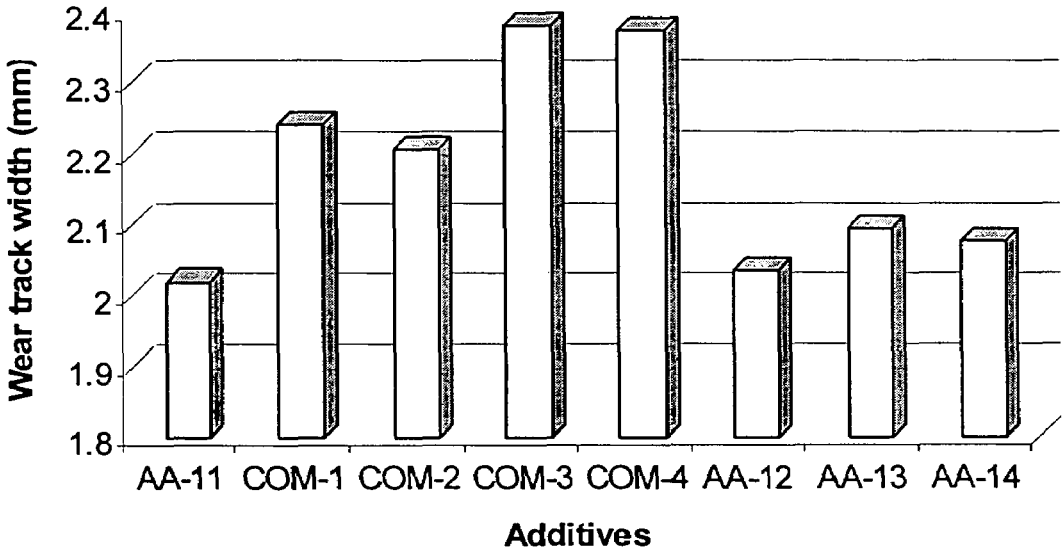
FIG. 2 is a bar graph showing observed wear track width (in mm) for four thioether derivatives of epoxidized soybean oil (AA-11, AA-12, AA-13, and AA-14) of the invention as compared to four commercial antifriction/antiwear additives (1% w/w derivatives and commercial additives in toluene solution) using a ball-on-disk test geometry (5 rpm, 181.44 Kg for 15 minutes at room temperature).

Antiwear properties of AA-11 in 1% w/w toluene solution compared with the commercial additives were evaluated in two different concentrations. Using the same conditions described in Example 2, wear track width (WTW) on the disk was measured at 4-5 different positions on the track and average value obtained. It was observed that additive AA-11 resulted in the lowest recorded WTW (in mm) compared to the commercial additive packages also in 1% w/w toluene solution (FIG. 2). In most cases, WTW from using AA-11 was less than half of the value of other additives.

EXAMPLE 4

Third Ball-on-Disk

Wear Track Width Evaluation (5% w/w)

Figure 3:
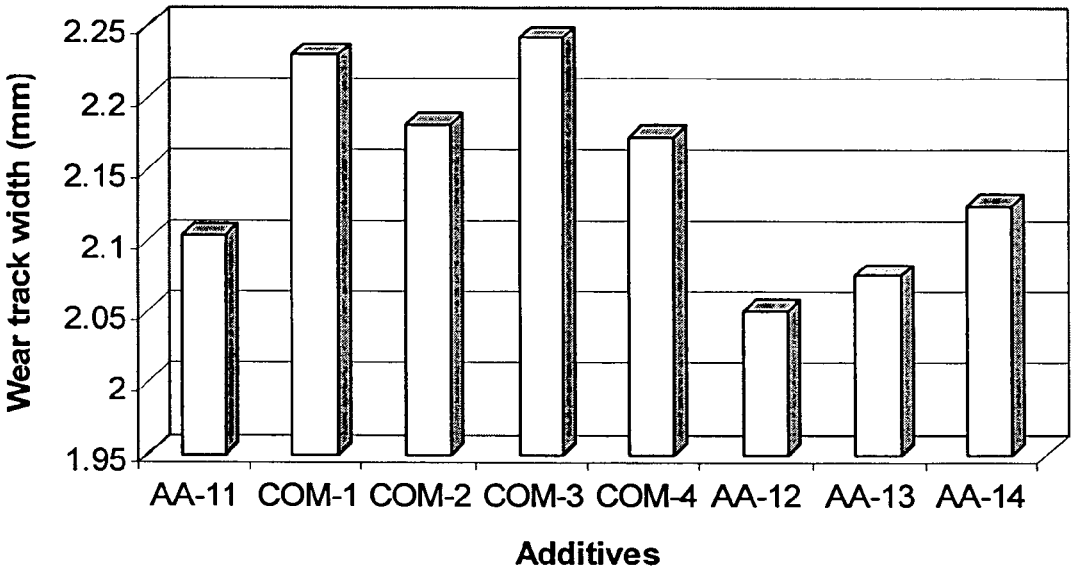
FIG. 3 is a bar graph showing observed wear track width (in mm) for four thioether derivatives of epoxidized soybean oil (AA-11, AA-12, AA-13, and AA-14) of the invention as compared to four commercial antifriction/antiwear additives (5% w/w derivative and commercial additives in toluene solution) using a ball-on-disk test geometry (5 rpm, 181.44 Kg for 15 minutes at room temperature).

Antiwear properties of AA-11 in 5% w/w toluene solution compared with the commercial additives were evaluated in two different concentrations. As shown in FIG. 3, the performance properties remained relatively similar to those observed at the 1% w/w level. Two of the commercial additives (COM-2 and COM-4) showed some decrease in the disk WTW while the other two (COM-1 and COM-3) remained relatively constant; though all were significantly higher than that observed for AA-11.

EXAMPLE 5

4-Ball Test

Wear Track Width and Scar Diameter Evaluation (5% w/w)

Coefficient of friction properties of AA-11 in toluene solution compared with the commercial additive packages COM-1 through COM-4 described above were evaluated.

Fifteen ml of test fluid (5 wt % additive dissolved in soybean oil) was poured in the test cup to cover the stationary balls. The test sequence allowed the speed to attain a set rpm of 1200 before a normal load of 40 Kg (88 lb) was applied at room temperature for 15 minutes. Temperature of the test fluid was 22° C., which increased to 27-28° C. at the end of the 15 min run. Duplicate tests were done with a new set of balls and the scar diameter varied within ±0.04 mm.

Figure 4:
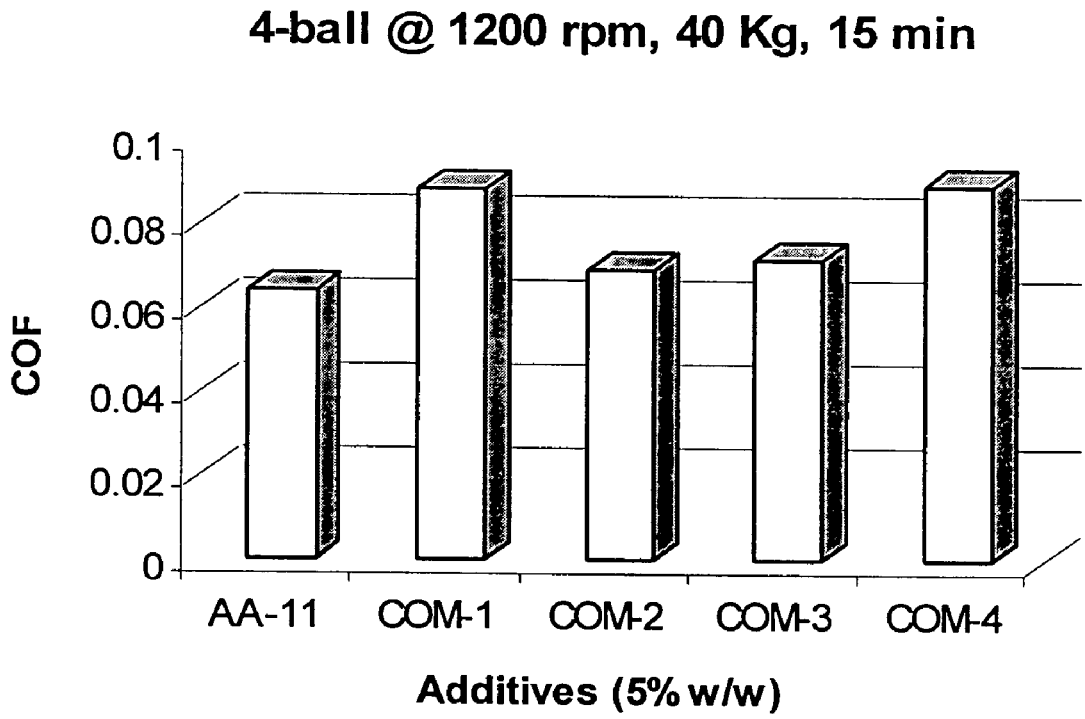
FIG. 4 is a bar graph showing the coefficient of friction (COF) for the 1-butane thioether of epoxidized soybean oil (AA-11) of the invention as compared to four commercial antifriction/antiwear additives (5% w/w concentration in soy oil base) using a modified 4-ball test method (1200 rpm, 40 Kg for 15 minutes duration at room temperature).

FIG. 4 shows that the COF as measured in the four-ball test is relatively less for AA-11 compared to the commercial antiwear additive packages. The low COF in AA-11 is due to excellent boundary lubrication property of the vegetable oil structure and the ability of the sulfur atom to react with the steel surface to form a stable iron sulfide surface coating. The ether linkage in AA-11 molecule is easily broken under the tribochemical condition with the release of elemental sulfur that can make stable complexation in place of oxygen with the active iron surface through an exchange mechanism.

Figure 5:
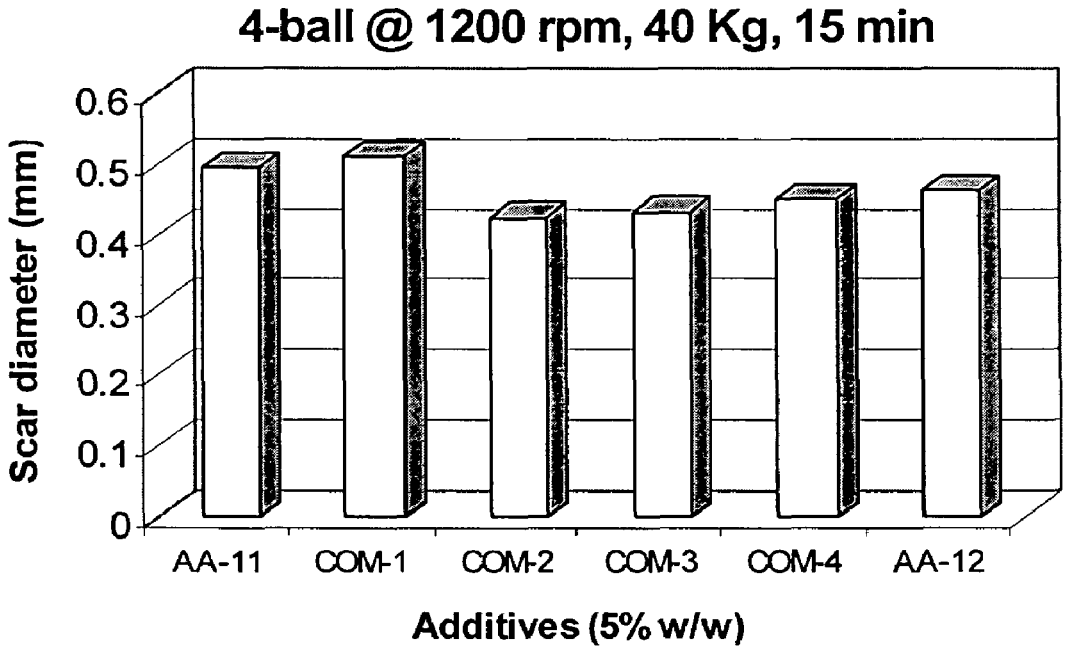
FIG. 5 is a bar graph showing the observed scar diameter (in mm) for two thioether derivatives of epoxidized soybean oil (AA-11 and AA-12) of the invention as compared to four commercial antifriction/antiwear additives (5% w/w concentration in soy oil) using a modified 4-ball test method (1200 rpm, 40 Kg for 15 minutes duration at room temperature).

Similarly, the results of the scar diameter measurement in the four-ball test as shown in FIG. 5 reveal that AA-11 molecule is comparable to other multi-component additive packages in terms of the efficiency of iron sulfide protective film formation. In most cases scar diameter up to 0.5 mm is an acceptable limit for most industrial antiwear applications.

EXAMPLE 6

Preparation and Evaluation of Additional Thio-derivatives

Vegetable oil-based thio-derivatives were synthesized by the same procedure described in Example 1 for product AA-11 using the following thio-compounds:

TABLE 1

| Vegetable Oil Thio-derivative | Thio-compound Reactant | Thio-compound Formula |
|---|---|---|
| AA-12 | 1-decanethiol | $CH_3(CH_2)_9SH$ |
| AA-13 | Cyclohexyl mercaptan | $C_6H_{11}SH$ |
| AA-14 | 1-octadecanethiol | $CH_3(CH_2)_{17}SH$ |

A four ball wear experiment was conducted with derivative AA-12 using the same set of test conditions described in Examples 2-5 for derivative AA-11. The results are illustrated in FIG. 5.

Friction and wear test data for AA-12, AA-13 and AA-14 using the Ball-on-Disk configuration described in Example 3 and 4 are presented in FIGS. 2 and 3, respectfully.

The data from the above tests demonstrates that derivatives AA-12, AA-13 and AA-14 manifest similar and sometimes better anti-friction/wear characteristics compared to AA-11. All of these bio-based specialty derivatives far exceed the performance level anti-wear properties of commercial additive packages.

All references disclosed herein or relied upon in whole or in part in the description of the invention are incorporated herein in their entirety by reference.

We claim:

1. A compound having the formula:

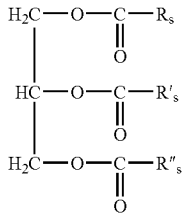

wherein $R_s$, $R_s'$ and $R_s''$ are independently selected from C7 to C21 aliphatic chains comprising derivatized methylene groups characterized by the structure:

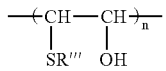

wherein R''' is (1) hydrogen; (2) a C1 to C22 hydrocarbon, wherein said hydrocarbon is a straight or branched chain, substituted or unsubstituted, saturated or unsaturated; (3) a 4- to 6-member heterocyclic ring, wherein said ring is substituted or unsubstituted, saturated or unsaturated; or a mixture thereof; and wherein n=0–4, with the proviso that the sum of n for $R_s$, $R_s'$, and $R_s''$ is greater than or equal to 2.

2. The compound of claim 1, wherein n is greater than or equal to 3.

3. The compound of claim 1, wherein R''' is a C3-C18 straight chain.

4. The compound of claim 1, wherein R''' comprises a 6-member carbon ring.

5. The compound of claim 1, wherein $R_s$, $R_s'$ and $R_s'$ are independently selected from C16 to C18 aliphatic chains.

6. A composition comprising a base stock material of mineral, vegetable, or synthetic origin, or mixtures thereof, and a compound having the formula:

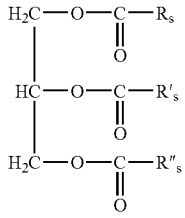

wherein $R_s$, $R_s'$ and $R_s''$ are independently selected from C7 to C21 aliphatic chains comprising derivatized methylene groups characterized by the structure:

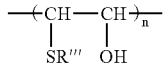

wherein R''' is (1) hydrogen; (2) a C1 to C22 hydrocarbon, wherein said hydrocarbon is a straight or branched chain, substituted or unsubstituted, saturated or unsaturated; (3) a 4- to 6-member heterocyclic ring, wherein said ring is substituted or unsubstituted, saturated or unsaturated; or (4) a mixture thereof; and wherein n=0–4, with the proviso that the sum of n for $R_s$, $R_s'$, and $R_s''$ is greater than or equal to 2.

7. The composition of claim 6, wherein n is greater than or equal to 3.

8. The composition of claim 6, wherein R''' is a C3-C18 straight chain hydrocarbon.

9. The composition of claim 6, wherein R''' comprises a 6-member carbon ring.

10. The composition of claim 6, wherein $R_s$, $R_s'$ and $R_s''$ are independently selected from C16 to C18 aliphatic chains.

11. A method for making a compound having the formula:

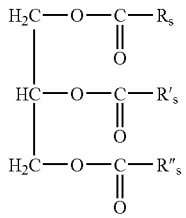

wherein $R_s$, $R_s'$ and $R_s''$ are independently selected from C7 to C21 aliphatic chains comprising derivatized methylene groups characterized by the structure:

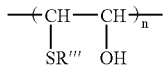

wherein R''' is (1) hydrogen; (2) a C1 to C22 hydrocarbon. wherein said hydrocarbon is a straight or branched chain, substituted or unsubstituted, saturated or unsaturated; (3) a 4- to 6-member heterocyclic ring, wherein said ring is substituted or unsubstituted, saturated or unsaturated; or (4) a mixture thereof; and wherein n=0–4, with the proviso that the sum of n for $R_s$, $R_s'$, and $R_s''$ is greater than or equal to 2;

comprising the steps of:

a. reacting in the presence of a ring-opening catalyst (1) an epoxidized triglyceride molecule having at least two oxirane rings on the fatty acid residues of said triglyceride molecule with (2) a sulfur-containing reactant selected from the group of hydrogen sulfide and a thiol; and b. recovering said compound.

12. The method of claim 11, wherein said sulfur-containing reactant is represented by the formula: HS-R''', wherein R''' is (1) hydrogen; (2) a C1 to C22 hydrocarbon, wherein said hydrocarbon is a straight or branched chain, substituted or unsubstituted, saturated or unsaturated; (3) a 4- to 6-member heterocyclic ring, wherein said ring is substituted or unsubstituted, saturated or unsaturated; or (4) a mixture thereof.

13. The method of claim 11, wherein n=0–4, with the proviso that the sum of n for $R_s$, $R_s'$, and $R_s''$ is greater than or equal to 2.

14. The method of claim 11, wherein said triglyceride is a drying oil.

15. The method of claim 11, wherein said triglyceride is selected from the group consisting of cotton seed oil, castor oil, canola oil, linseed oil, oiticica oil, safflower oil, soybean oil, sunflower oil, corn oil, and tung oil and a mixture thereof.

16. The method of claim 11, wherein said triglyceride is soybean oil.

17. The method of claim 11, wherein said catalyst is an acid catalyst.

18. The method of claim 12, wherein R''' is a C3-C18 straight chain hydrocarbon.

19. The method of claim 12, wherein R''' comprises a 6-member carbon ring.

* * * * *